US010887707B2

(12) United States Patent
Johansen

(10) Patent No.: US 10,887,707 B2
(45) **Date of Patent: *Jan. 5, 2021**

(54) HEARING AID DEVICE

(71) Applicant: GN HEARING A/S, Ballerup (DK)

(72) Inventor: Jan Johansen, Koge (DK)

(73) Assignee: GN Hearing A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/110,901

(22) Filed: Aug. 23, 2018

(65) Prior Publication Data

US 2018/0367924 A1 Dec. 20, 2018

Related U.S. Application Data

(63) Continuation of application No. 14/820,405, filed on Aug. 6, 2015, now Pat. No. 10,187,735.

(30) Foreign Application Priority Data

Jan. 30, 2015 (DK) ..... 2015 70052
Jan. 30, 2015 (EP) ..... 15153165

(51) Int. Cl.
*H04R 25/00* (2006.01)

(52) U.S. Cl.
CPC ..... *H04R 25/65* (2013.01); *H04R 25/60* (2013.01); *H04R 2225/021* (2013.01)

(58) Field of Classification Search
CPC ... H04R 2225/021; H04R 25/60; H04R 25/65
(Continued)

(56) References Cited

U.S. PATENT DOCUMENTS 8,385,573 B2 2/2013 Higgins
8,467,553 B2 6/2013 Schefer
(Continued)

FOREIGN PATENT DOCUMENTS

EP 2 107 830 A2 10/2009

OTHER PUBLICATIONS

First technical examination and Search Repot dated Apr. 24, 2015, for corresponding Danish Patent Application No. PA 2015 70052, 8 pages.

(Continued)

*Primary Examiner* — Phylesha Dabney
(74) *Attorney, Agent, or Firm* — Vista IP Law Group, LLP

(57) ABSTRACT

A hearing aid device includes: a hearing aid housing surrounding an inner space; a frame structure arranged in the inner space, the frame structure configured for mounting at least a microphone and a signal processing unit; a sound emitter sized for being arranged in an ear canal; a conductor, wherein the sound emitter is arranged on a first end of the conductor; a connector socket arranged in the frame structure, wherein the hearing aid housing comprises a passage located in front of the connector socket; a connector plug arranged on a second end of the conductor, the connector plug configured for insertion through the passage for connection to the connector socket; a recess at an outer surface of the connector plug; and a locking plug having a first part configured to extend through a housing opening at the hearing aid housing, and engage with the recess.

37 Claims, 3 Drawing Sheets

(58) Field of Classification Search
USPC ..... 381/324
See application file for complete search history.

(56) References Cited

U.S. PATENT DOCUMENTS

| | | | | |
|---|---|---|---|---|
| 8,638,965 | B2 | 1/2014 | Higgins | |
| 9,578,429 | B2 | 2/2017 | Karamuk | |
| 10,187,735 | B2 * | 1/2019 | Johansen | H04R 25/60 |
| 2001/0040973 | A1 | 11/2001 | Fritz | |
| 2008/0212813 | A1 | 9/2008 | Kral et al. | |
| 2008/0260193 | A1 | 10/2008 | Westermann et al. | |
| 2009/0074218 | A1 | 3/2009 | Higgins | |
| 2009/0304216 | A1 | 12/2009 | Hansen | |
| 2010/0111341 | A1 | 5/2010 | Dittli et al. | |
| 2013/0004005 | A1 | 1/2013 | Barth et al. | |
| 2014/0079262 | A1 | 3/2014 | Angst et al. | |
| 2014/0119586 | A1 | 5/2014 | Mortensen et al. | |
| 2014/0205120 | A1 | 7/2014 | Barth et al. | |
| 2015/0237453 | A1 | 8/2015 | Kaminski | |

OTHER PUBLICATIONS

Extended European Search Report dated Jul. 29, 2015, for corresponding European Application No. 15153165.4, 9 pages.
Second Technical Examination dated May 10, 2016, for corresponding Danish Patent Application No. PA 2015 70052, 3 pages.
Non-Final Office Action dated Sep. 8, 2016, for related U.S. Appl. No. 14/820,405.
Final Office Action dated May 19, 2017, for related U.S. Appl. No. 14/820,405.
Non-Final Office Action dated Dec. 14, 2017, for related U.S. Appl. No. 14/820,405.
Final Office Action dated Jun. 25, 2018, for related U.S. Appl. No. 14/820,405.
Summons to attend oral proceedings dated Nov. 22, 2018 for corresponding European Application No. 15153165.4.

* cited by examiner

HEARING AID DEVICE

RELATED APPLICATION DATA

This application is a continuation of U.S. patent application Ser. No. 14/820,405 filed on Aug. 6, 2015, pending, which claims priority to and the benefit of Danish Patent Application No. PA 2015 70052 filed on Jan. 30, 2015, and European Patent Application No. 15153165.4 filed on Jan. 30, 2015. The entire disclosures of all of the above applications are expressly incorporated by reference herein.

FIELD

The present disclosure relates to the field of hearing aid devices.

BACKGROUND

A hearing aid device may include a hearing aid housing, a microphone for converting sound into an audio input signal, and a signal processing unit adapted for processing the audio input signal into an audio output signal. A hearing aid may also include a sound emitter sized for being arranged in the ear canal of a human being. In some cases, the sound emitter (ear plug) may be arranged on one end of a conductor adapted for transmitting sound or electrical signal to the sound emitter.

Hearing aid devices of the above mentioned kind have been disclosed in US patent application publication nos. 2014079262 and no. 2009304216, and in U.S. Pat. No. 8,385,573.

SUMMARY

When assembling hearing aid devices, it is desirable that each component be produced with very fine tolerances in order to provide the best fit between the individual components. This is, for example, due to the importance of avoiding that badly interconnected or assembled components may give rise to undesirable noises reducing the quality of the sound heard by the person wearing the hearing aid device. On the other hand such high requirements to the quality of the components may increase the production costs significantly and therefore it is a constantly recurring challenge to design hearing aid devices providing the best possible sound quality per production cost unit.

Based on this, it is an object to propose a hearing aid device with the option of reducing the requirements to the production tolerances but at the same time providing a good fit between the separate components.

According to one or more embodiments described herein, this is achieved by having the hearing aid housing the frame structure and the locking plug mutually adapted so that at least a part of said locking plug locking the connector plug in the socket, also interlocks the frame structure and the hearing aid housing in its inserted position.

Thereby the connector plug, the hearing aid housing and the frame are mutually interconnected by a single component providing the option of concentrating the required fine production tolerances in this component and in the areas of the other components (the frame and the hearing aid housing) abutting the locking plug. This further provides the option of producing other parts of these components with relatively rough tolerances and at the same time keeping a good fit between the components.

This advantage may be achieved with hearing aid devices (e.g. the so called RITE "Receiver In The Ear" or the RIC "Receiver In Canal" type hearing aid device) where the sound emitter comprises a receiver configured for receiving said audio output signal from said signal processing unit, and the connector socket comprises conductor comprises electrical wiring configured for conducting said audio output signal to the receiver, as well as with hearing aid devices (e.g. the so called BTE "Behind The Ear" type hearing aid) where a receiver, configured for receiving said audio output signal from said signal processing unit, is arranged in the inner space in the hearing aid housing and connected to said connector socket and producing an output sound signal through the connector socket to said conductor comprising a tube configured for conducting said output sound signal from the connector socket and to the sound emitter.

In an embodiment the locking plug has the shape of a "U" comprising a first leg and a second leg and an intermediate section connecting the first and the second leg. In this relation the first leg may form the above mentioned first part of the locking plug locking the connector plug in the socket, and the second leg may interlock the frame structure and the housing.

In order to provide easy removal of the locking plug from the hearing aid device the locking plug comprises a surface being visible from outside the hearing aid housing when it is inserted in the hearing aid housing, and the colour of said surface on the locking plug differs from the colour of the hearing aid housing.

In this relation the hearing aid housing may comprise a concave surface, and the hearing aid housing and the locking plug being configured so that the visible surface on the locking plug is flush with said concave surface on the hearing aid housing. As the wearer normally carries the hearing aid so that the concave side of the hearing aid housing faces the his ear, then this embodiment, and especially if the visible surface is completely surrounded by the concave surface, provides the option of wearing the hearing aid housing so that the visible surface on the locking plug is not visible for others. The skilled person will in this relation easily recognize that the principle of having the visible surface of the locking plug completely surrounded by the concave surface of the hearing aid housing can be used in relation to most other BTE type hearing aids independently of the above mentioned embodiments.

The hearing aid may further comprise two locking plugs of the above mentioned kind being shaped substantially identical so that the two locking plugs are interchangeable. In this relation the visible surface on the locking plugs may be different, e.g. having different respective identification features. For example, colors such as red and green or different ornamentation such as an "L" and an "R" shaped ornamentation, would enable the user to easily identify the hearing aid housing that is to be placed behind his left or right ear. As another example of identification feature, the locking plugs may have different respective textures or surface finishes. In further example, the visible parts of the locking plugs may have different respective shapes. The skilled person will in this relation easily recognize that the principle of having locking plugs with different visible surfaces can be used in relation to most other BTE type hearing aids independently of the above mentioned embodiments.

In a further embodiment the locking plug is configured so that the part that mutually interlocks said frame structure and said housing, comprises two resilient legs extending on opposite sides of the connector plug in its locked position in the connector socket.

In this relation the resilient legs and/or the connector plug may advantageously comprise oblique surfaces arranged so that the resilient legs are forced away from each other if the locking plug is mounted in the hearing aid housing when the connector plug is inserted into the connector socket.

A hearing aid device includes: a hearing aid housing surrounding an inner space; a frame structure arranged in the inner space of the hearing aid housing, the frame structure configured for mounting at least a microphone for converting sound into an audio input signal, and a signal processing unit configured for providing an audio output signal based on the audio input signal; a sound emitter sized for being arranged in an ear canal of a human being; a conductor configured for transmitting output sound or an output electrical signal to the sound emitter, wherein the sound emitter is arranged on a first end of the conductor; a connector socket arranged in the frame structure, wherein the hearing aid housing comprises a passage located in front of the connector socket; a connector plug arranged on a second end of the conductor, the connector plug being configured for insertion through the passage of the hearing aid housing for connection to the connector socket, a recess at an outer surface of the connector plug; and a locking plug configured for being inserted from outside of the hearing aid housing so that a first part of the locking plug extends through a housing opening at the hearing aid housing, and engages with the recess to lock the connector plug relative to the connector socket.

Optionally, the conductor is configured to transmit the output electrical signal, not the output sound, and wherein the sound emitter comprises a receiver configured for receiving the output electrical signal transmitted via wiring in the conductor.

Optionally, the conductor is configured to transmit the output sound, not the output electrical signal; wherein the hearing aid further comprises a receiver arranged in the hearing aid housing, the receiver configured to provide the output sound to the conductor for transmission to the sound emitter through the conductor.

Optionally, the locking plug has a U-shape, and comprises a first leg, a second leg, and an intermediate section connecting the first leg and the second leg, wherein the first leg comprises the first part of the locking plug, and wherein the second leg is configured to interlock the frame structure and the hearing aid housing relative to each other.

Optionally, the locking plug comprises an exterior surface visible from outside the hearing aid housing when the locking plug is inserted in the hearing aid housing, and wherein the exterior surface of the locking plug has a color that is different from a color of the hearing aid housing.

Optionally, the hearing aid housing comprises a concave surface, and the exterior surface of the locking plug is flush with the concave surface of the hearing aid housing when the locking plug is inserted in the hearing aid housing.

Optionally, the exterior surface of the locking plug is surrounded by the concave surface of the hearing aid housing.

Optionally, the hearing aid device further include an additional locking plug, wherein the locking plug and the additional locking plug are interchangeable, and have different respective identification features.

Optionally, the first part of the locking plug comprises two resilient legs extending on opposite sides of the connector plug when the connector plug is connected to the connector socket.

Optionally, the resilient legs are displaceable away from each other when the locking plug is being mounted to the hearing aid housing.

Optionally, when the locking plug is inserted from the outside of the hearing aid housing, the first part of the locking plug also extends through an opening at the frame structure.

Optionally, the connector plug is also configured to lock the frame structure relative to the hearing aid housing.

Other features, embodiments, and advantageous will be described below in the detailed description.

DETAIL DESCRIPTION

Figure 1:
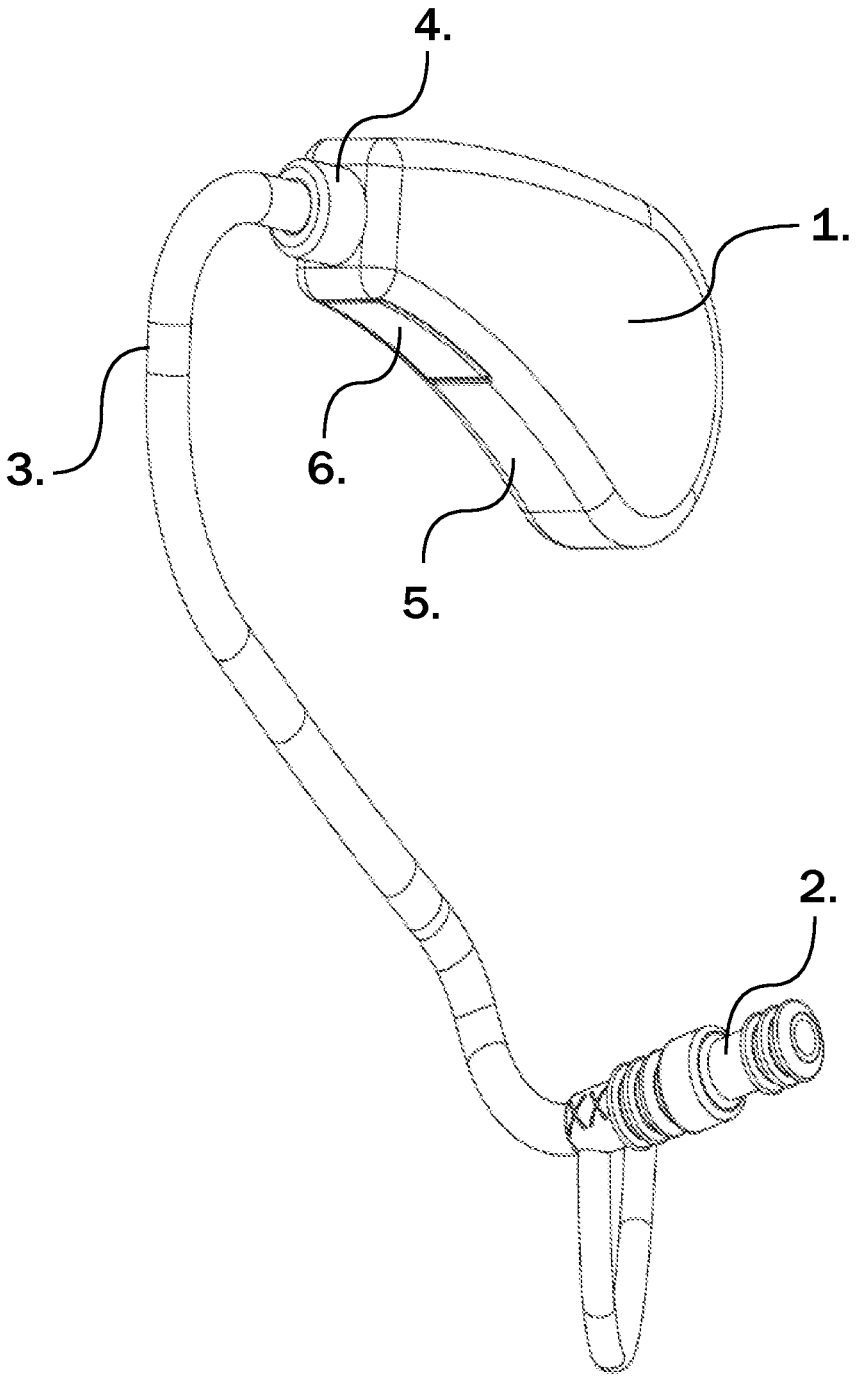
FIG. 1 shows a hearing aid device according to some embodiments.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Thus, FIG. 1 shows a hearing aid device of the BTE (Behind The Ear) or the RITE (Receiver In The Ear) type. The hearing aid device has a hearing aid housing 1 and a separate sound emitter 2 connected to the hearing aid housing via a conductor 3 being releasably plugged into the hearing aid housing 1 via a connector plug 4. In order to keep the connector plug 4 attached to the hearing aid housing 1 a locking plug 6 is inserted into the hearing aid housing through an opening arranged in a concave surface 5 on the outside of the hearing aid housing 1.

As will be described in more detail below the hearing aid housing encloses a frame structure 7 providing a secure support for mounting various functional components of hearing aid devices, such as a microphone arranged for converting exterior sound into an audio input signal and a signal processing unit 8 configured for processing the audio input signal according to a hearing loss of a user of the hearing device into an audio output signal. As it is evident for the skilled person that these and other functional components may be mounted to the frame 7 in many different ways and positions, then most of these components are not shown in these drawings.

Figure 2:
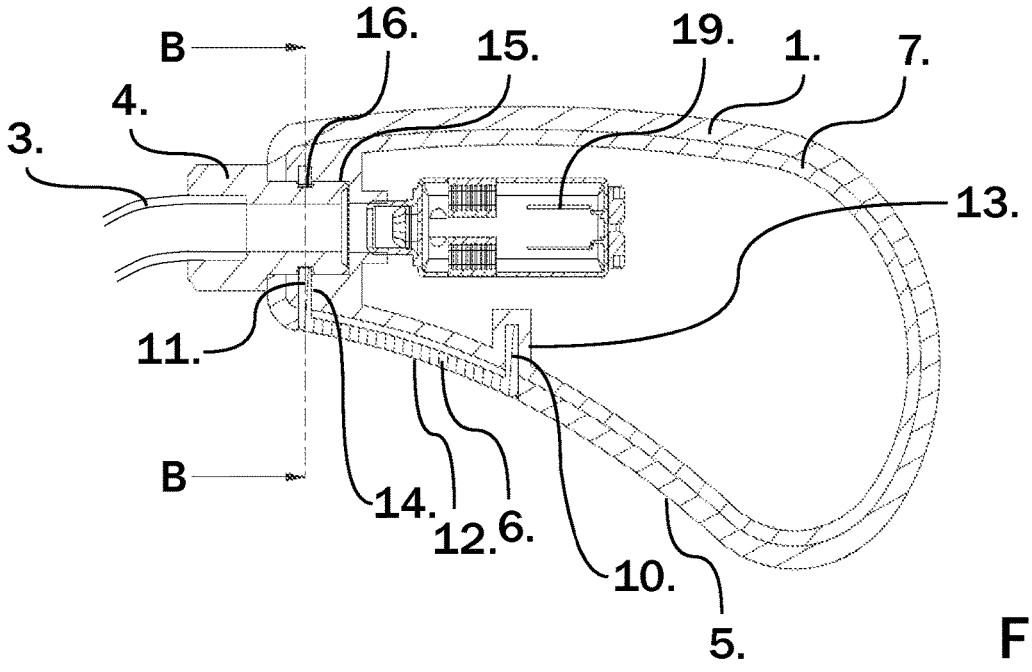
FIG. 2 shows a cross section along the line A-A shown in FIG. 2*a* of a part of the hearing aid device shown in FIG. 1 in one embodiment.
Figure 2B:
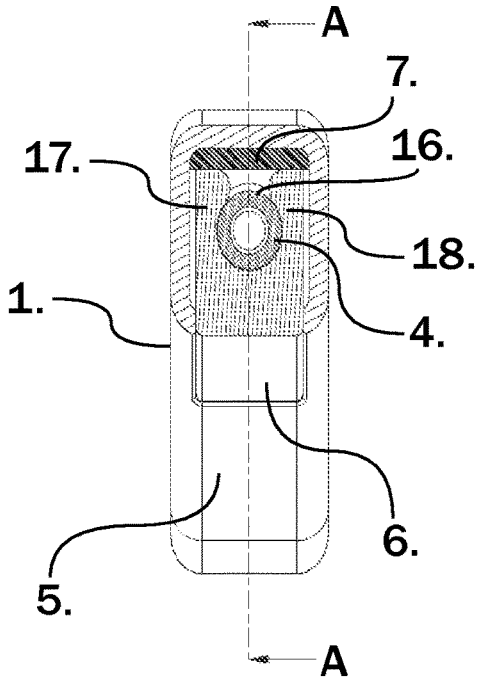
FIG. 2*b* is a cross section along the line B-B shown in FIG. 2
Figure 2A:
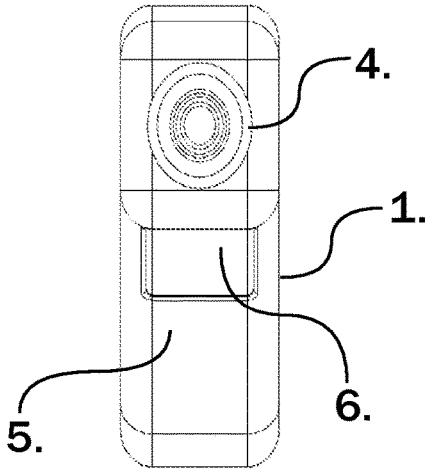
FIG. 2*a* is a front view of the hearing aid device part shown in FIG. 2.

In the BTE embodiment shown on FIGS. 2, 2*a* and 2*b* the hearing aid housing 1 also encloses a receiver 19 configured for converting the audio output signal from the signal processing unit (not shown in this drawing) into an output sound, and the conductor 3 is a tube configured for transmitting the output sound to the sound emitter 2 (not shown in this drawing).

Figure 3:
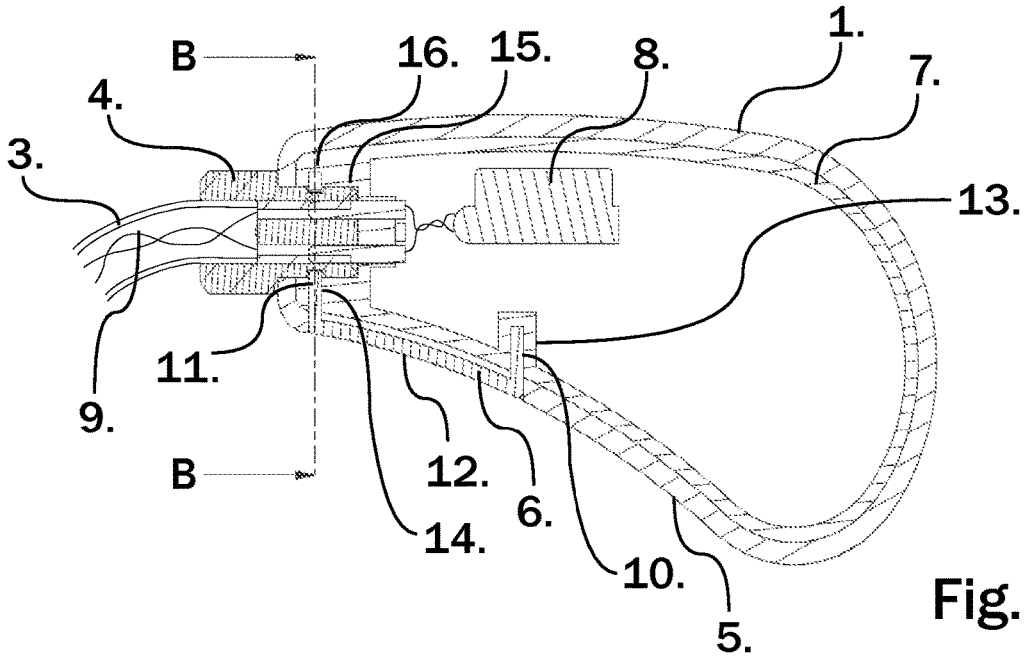
FIG. 3 shows a cross section along the line A-A shown in FIG. 3*a* of a part of the hearing aid device shown in FIG. 1 in an alternative embodiment.
Figure 3B:
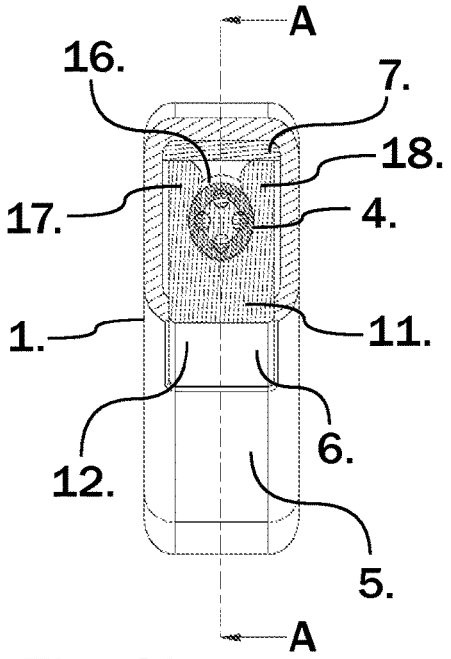
FIG. 3*b* is a cross section along the line B-B shown in FIG. 2 or 3.
Figure 3A:
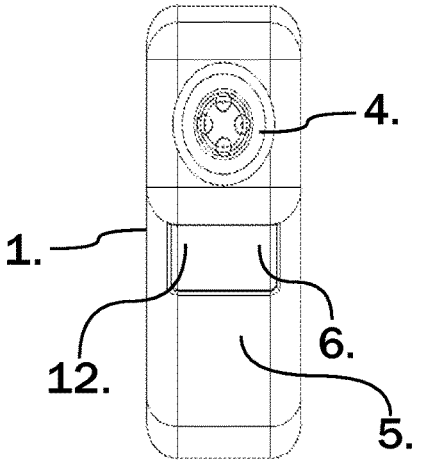
FIG. 3*a* is a front view of the hearing aid device part shown in FIG. 3.

In the RITE embodiment shown on FIGS. 3, 3*a* and 3*b*, the receiver (not shown) configured for converting the audio output signal (output electrical signal) from the signal processing unit 8 into an output sound is arranged in the sound emitter 2 shown on FIG. 1, and the conductor 3 is in this embodiment configured for transmitting, e.g. with electrical wiring 9, the audio output signal (output electrical signal) to the receiver arranged in the sound emitter 2.

In these embodiments the locking plug 6, both in the BTE and the RITE version shown in FIGS. 2, 2*a*, 2*b* and FIGS. 3, 3*a*, 3*b* respectively, has a U-shaped configuration with a first leg 10 and a second leg 11 and an intermediate portion extending between the first leg 10 and the second leg 11 and the intermediate portion forms the visible surface 12 on the locking plug 6.

This provides the option of providing different ornamentation or colouring on the visible surface 12 on the intermediate portion of the locking plug 6 in order e.g., to show information, such as a left/right indication, to the user. Due to the fact that the visible surface 12 on the locking plug 6 is arranged on the concave surface or side 5 of the hearing aid housing 1, then this information will be concealed for others, due to the fact that the concave surface or side 5 most often faces the ear of the user carrying the hearing aid housing behind the ear.

As shown especially on FIGS. 2 and 3 the first leg 10 extends into a first slot 13 in the frame structure 7 and the second leg 11 extends into a second slot 14 in the frame structure 7 so that the intermediate portion is held in a fixed position extending between the two slots. Due to the locking plug 6 being fixed with respect to the frame structure 7, and the intermediate portion fitting snugly into an opening in the hearing aid housing 1, then the hearing aid housing 1 is thereby fixed by the locking plug 6 with respect to the frame structure 7.

As mentioned above the connector plug 4 is inserted into the hearing aid housing 1 where it is connected to the connector socket 15. In order to fix the connector plug 4 in the connector socket 15 the free end of the second leg 11 on the locking plug 6 is formed by two resilient legs 17, 18 that extends via the second slot 14 into the connector socket 15 formed in the frame structure 7, and so that each resilient leg 17, 18 engages with a recess 16 on opposite sides of the connector plug 4 and thereby locks the connector plug 4 in its inserted position in the connector socket 15.

In the above embodiments, both the first leg 10 and the second leg 11 of the locking plug 6 are inserted into respective openings at the frame structure 7. In other embodiments, only one of the legs 10, 11 is inserted into an opening at the frame structure 7. For example, in other embodiments, the first leg 10 may be inserted through a housing opening at the hearing aid housing to reach the connector plug 4. In such case, the frame structure 7 does not have an opening for allowing the first leg 10 to extend therethrough.

Also, in other embodiments, the locking plug 6 may not include the second leg 11.

Although some embodiments have been described and shown in detail, the claimed invention is not restricted to them, but may also be embodied in other ways within the scope of the subject matter defined in the following claims. In particular, it is to be understood that other embodiments may be utilized and structural and functional modifications may be made without departing from the scope of the claimed invention. As an example of this it will be apparent to the skilled person that the claimed invention may also be used in relation to hearing aids having other or different functional components arranged in the hearing aid housing 1 or the sound emitter 2 than what has been mentioned above.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A hearing aid device, comprising:

an elongated member with a connector, the elongated member having a member end for coupling with an earpiece;

a structure; and a connector lock configured to secure the connector of the elongated member relative to the structure of the hearing aid device;

wherein the connector lock comprises a first end, a second end, and a body extending between the first end and the second end of the connector lock;

wherein the connector lock has a first part at the first end, and wherein the first part of the connector lock is configured to engage with the connector to secure the connector relative to the structure;

wherein the connector lock has a second part, wherein the second part forms an angle with respect to the body; and wherein the first part of the connector lock has two resilient members, the resilient members having respective member bodies and respective free ends, wherein the member bodies define a first spacing, and wherein the free ends define a second spacing that is different from the first spacing.

2. The hearing aid device of claim 1, wherein the structure comprises a frame and a hearing aid housing.

3. The hearing aid device of claim 1, wherein the first part is configured for insertion into an opening of the structure.

4. The hearing aid device of claim 1, wherein one of the resilient members is configured to be displaced in a direction that is perpendicular to a longitudinal extent of the connector lock.

5. The hearing aid device of claim 1, wherein the two resilient members extend on opposite sides of the connector.

6. The hearing aid device of claim 1, wherein the two resilient members are displaceable away from each other by the connector.

7. The hearing aid device of claim 1, wherein the structure comprises a passage; and wherein the connector comprises a connector plug configured for insertion into the passage of the structure.

8. The hearing aid device of claim 1, wherein the elongated member is configured to transmit an electrical signal.

9. The hearing aid device of claim 1, wherein the elongated member is configured to transmit sound.

10. The hearing aid device of claim 1, wherein the structure comprises a hearing aid housing or is coupled to the hearing aid housing.

11. The hearing aid device of claim 10, wherein the connector lock comprises an exterior surface visible from outside the hearing aid housing when the connector lock is inserted in the hearing aid housing, and wherein an exterior surface of the connector lock has a color that is different from a color of the hearing aid housing.

12. The hearing aid device of claim 11, wherein the hearing aid housing comprises a surface, and the exterior surface of the connector lock is flush with the surface of the hearing aid housing when the connector lock is coupled with the hearing aid housing.

13. The hearing aid device of claim 11, wherein the exterior surface of the connector lock is surrounded by a surface of the hearing aid housing.

14. The hearing aid device of claim 10, wherein the connector lock is configured to be inserted from outside of the hearing aid housing.

15. The hearing aid device of claim 1, further comprising an additional connector lock, wherein the connector lock and the additional connector lock are interchangeable, and have different respective identification features.

16. The hearing aid device of claim 1, further comprising a hearing aid housing, wherein the connector lock is configured to lock the structure relative to the hearing aid housing.

17. The hearing aid device of claim 1, further comprising a hearing aid housing, wherein the structure comprises a surface that abuts against an inner surface of the hearing aid housing.

18. The hearing aid device of claim 1, wherein the first part and the second part of the connector lock are at different respective positions along a longitudinal axis of the connector lock.

19. The hearing aid device of claim 1, further comprising a signal processing unit and a hearing aid housing, wherein at least a part of the structure is located between the signal processing unit and a portion of the hearing aid housing.

20. The hearing aid device of claim 1, further comprising a signal processing unit, wherein the structure comprises a hearing aid housing, and wherein the signal processing unit is located in the hearing aid housing.

21. A hearing aid device, comprising:

an elongated member with a connector, the elongated member having a member end for coupling with an earpiece;

a structure; and a connector lock configured to secure the connector of the elongated member relative to the structure of the hearing aid device;

wherein the connector lock comprises a first end, a second end, and a body extending between the first end and the second end of the connector lock;

wherein the connector lock has a first part at the first end, and wherein the first part of the connector lock is also configured to engage with the connector to secure the connector relative to the structure;

wherein the connector lock has a second part;

wherein the structure comprises a hearing aid housing, the hearing aid housing containing a frame; and wherein the second part of the connector lock is sized for insertion through an opening at the hearing aid housing to engage with the frame contained in the hearing aid housing.

22. A hearing aid device, comprising:

an elongated member with a connector, the elongated member having a member end for coupling with an earpiece;

a structure; and a connector lock configured to secure the connector of the elongated member relative to the structure of the hearing aid device;

wherein the connector lock comprises a first end, a second end, and a body extending between the first end and the second end of the connector lock;

wherein the connector lock has a first part at the first end, and wherein the first part of the connector lock is also configured to engage with the connector to secure the connector relative to the structure; and wherein the body of the connector lock comprises an exterior surface configured to abut a skin of a user when the hearing aid device with the connector lock is being worn by the user.

23. The hearing aid device of claim 22, wherein the structure comprises a frame in the hearing aid housing.

24. The hearing aid device of claim 22, wherein the structure comprises a part of the hearing aid housing.

25. The hearing aid device of claim 22, wherein the first part is configured for insertion into an opening of the structure.

26. The hearing aid device of claim 22, wherein the first part comprises two resilient members.

27. The hearing aid device of claim 26, wherein one of the resilient members is configured to be displaced in a direction that is perpendicular to a longitudinal extent of the connector lock.

28. The hearing aid device of claim 26, wherein the two resilient members extend on opposite sides of the connector.

29. The hearing aid device of claim 26, wherein the two resilient members are displaceable away from each other by the connector.

30. The hearing aid device of claim 22, wherein the structure comprises a passage; and wherein the connector comprises a connector plug configured for insertion into the passage of the structure.

31. The hearing aid device of claim 22, wherein the exterior surface is visible from outside the hearing aid housing when the connector lock is inserted in the hearing aid housing, and wherein an exterior surface of the connector lock has a color that is different from a color of the hearing aid housing.

32. The hearing aid device of claim 22, wherein the hearing aid housing comprises a surface, and the exterior surface of the body of the connector lock is flush with the surface of the hearing aid housing when the connector lock is coupled with the hearing aid housing.

33. The hearing aid device of claim 22, wherein the exterior surface of the body the connector lock is surrounded by a surface of the hearing aid housing.

34. The hearing aid device of claim 22, further comprising an additional connector lock, wherein the connector lock and the additional connector lock are interchangeable, and have different respective identification features.

35. The hearing aid device of claim 22, wherein the connector lock is configured to lock the structure relative to the hearing aid housing.

36. The hearing aid device of claim 22, wherein the structure comprises a surface that abuts against an inner surface of the hearing aid housing.

37. The hearing aid device of claim 22, further comprising a signal processing unit located in the hearing aid housing.

* * * * *